US005916249A

United States Patent [19]

Baker

[11] Patent Number: 5,916,249

[45] Date of Patent: Jun. 29, 1999

[54] METHOD AND APPARATUS FOR THE RECOVERY OF AMMONIA REFRIGERANT

[76] Inventor: H. Wayne Baker, 992 Buttermilk Rd., Russellville, Ark. 72801

[21] Appl. No.: 08/841,489

[22] Filed: Apr. 23, 1997

[51] Int. Cl.[6] ..... F25B 43/00

[52] U.S. Cl. ..... 62/85; 62/292; 62/77; 62/149; 62/335; 62/430; 62/434; 62/79; 62/238.6; 62/238.7

[58] Field of Search ..... 62/292, 77, 149, 62/335, 430, 434, 79, 238.6, 238.7

[56] References Cited

U.S. PATENT DOCUMENTS

| | | | |
|---|---|---|---|
| 4,294,664 | 10/1981 | Anthony | 203/19 |
| 4,402,795 | 9/1983 | Erickson | 203/25 |
| 4,441,330 | 4/1984 | Lower et al. | 62/292 |
| 4,476,688 | 10/1984 | Goddard | 62/292 |
| 4,753,016 | 6/1988 | Eichholz | 34/86 |
| 5,335,508 | 8/1994 | Tippmann | 62/434 |

*Primary Examiner*—Henry Bennett
*Assistant Examiner*—Mal Shulman
*Attorney, Agent, or Firm*—Ray F. Cox, Jr.

[57] ABSTRACT

A method of and apparatus for recovery of ammonia refrigerant using paired evaporation condensation processes in which an essentially closed water loop is used to efficiently transfer heat energy from the evaporation process to the condensation process and which further allows excess heat to be purged from the system by evaporation of water in a forced draft condenser.

20 Claims, 2 Drawing Sheets

METHOD AND APPARATUS FOR THE RECOVERY OF AMMONIA REFRIGERANT

BACKGROUND OF THE INVENTION

The present invention is directed to a method and apparatus for recovery of refrigerant using paired evaporation/condensation processes and specifically to a method and apparatus in which an essentially closed water loop is used to efficiently transfer heat energy from the evaporation process to the condensation process and which further allows excess heat to be purged from the system by evaporation of water in a forced draft condenser.

Ammonia refrigerant is commonly used on large commercial and industrial refrigeration units. The present invention differs from present practice in the industry in that ammonia refrigerant systems requiring service typically vent ammonia directly to the atmosphere. This procedure is no longer possible due to the increased stringency of environmental and occupational safety regulations which limit the amount of ammonia which may be vented to the atmosphere. For larger systems it is, therefore, necessary to provide some means to recover the ammonia refrigerant that does not require venting of ammonia to the atmosphere.

Recovery of refrigerant without venting to the atmosphere involves the recovery of relatively pure refrigerant from refrigerant contaminated with waste materials such as water and oil. The refrigerant is removed from the refrigeration system and introduced to an evaporator. A compressor induces a reduced pressure on the refrigerant in the evaporator which causes the refrigerant to evaporate and be removed as a gas, while the water and oil and other contaminants remain behind in the evaporator where they can be drained off. The compressor transfers the warm gaseous refrigerant to a condenser where it is condensed at a higher pressure to a liquid. The liquid refrigerant enters a receiver from where it can be pumped to a storage vessel or to a refrigeration system. The evaporation of the refrigerant requires the input of heat. In addition, the condensation of the gaseous refrigerant to a liquid produces heat. Furthermore, the compressor adds additional compression heat to the condensed liquid.

There are various patents, primarily in the drying or distillation arts, that employ various means of heat recovery. This is advantageous whenever there exists both vaporization and condensation processes going on simultaneously.

For example, U.S. Pat. No. 4,753,016 issued to Eicholz on Jun. 28, 1988 discloses a condensation process for water vapor under vacuum which is taken from a drying apparatus. The water vapor is condensed into a liquid and heat is recovered from the condensed water for use in the drying process. Additionally heat is recovered from pumps by placing the pumps in an insulated casing where a heat exchanger is used to add this waste heat to the condensed water. This patent does not involve refrigerant recovery and does not employ a closed circuit water loop between evaporation and condensation processes.

U.S. Pat. No. 4,402,795 issued to Erickson on Sep. 6, 1983 is more nearly similar in principle to the present invention. Erickson discloses a means for reducing the energy consumed by thermal separation processes such as distillation. Part of the heat rejected by the process is recovered by a reverse absorption heat pump, then upgraded and returned to the distillation process. This is a complicated process which is necessary due to the need to upgrade the rejected heat before reuse in the process.

U.S. Pat. No. 4,294,664 issued to Anthony on Oct. 13, 1981 discloses a process that captures latent heat of condensation by condensing a process vapor and returning the captured heat to the remaining process liquid for continued vaporization. Anthony has the specific intention of obtaining ethanol from a boiling mixture of wort and water. The ethanol is condensed to a liquid and the heat of condensation is captured to assist in the boiling of the mixture. Anthony employs two loops. One loop employs a refrigerant gas which is compressed to deliver heat to the boiling process liquid and is cooled by a second loop of water. This apparatus is complex and is not adapted to refrigerant recovery.

The prior art does not suggest the use of the heat recovery principle in the recovery of refrigerant nor the use of a single essentially closed loop of circulating water between the evaporator and condenser. The prior art shows various forms of heat recovery in unrelated fields, but not for the recovery of refrigerant working fluids. Furthermore, none of the prior art references show a water loop mechanism of the present invention.

The problems and limitations of the prior art are overcome by the present invention as summarized below.

SUMMARY OF THE INVENTION

The present invention is a method and apparatus to recover contaminated refrigerant. Although the invention may be used to recover any liquid refrigerant, ammonia is specifically discussed herein since it is the most commonly used refrigerant in large commercial systems. Recovery of ammonia involves removal of water and oil and other contaminants from the refrigerant to produce relatively pure ammonia. The refrigerant ammonia is removed from the refrigeration system and introduced into an evaporator. A compressor induces a reduced pressure on the ammonia in the evaporator which causes the ammonia to evaporate and be removed as a gas, while the water and oil and other contaminants remain behind in the evaporator where they can be drained off. The compressor transfers the warm gaseous ammonia to a condenser where it is condensed at higher pressure to a liquid. The liquid ammonia may then enter a receiver from where it can be pumped to a storage vessel or system. To this point the apparatus is conventional. The novel aspect of the apparatus is the use of an essentially closed circulating water loop which passes through the condenser where it picks up the heat of condensation of the ammonia and then passes through the evaporator where it gives up heat to assist in the vaporization of the ammonia.

In order to maintain high energy efficiency in the recovery process, the present invention uses a circulating water loop which passes through the condenser where it picks up the heat of condensation of the ammonia and then passes through the evaporator where it gives up heat to assist in the vaporization of the ammonia. The water loop may be operated as a closed recirculating loop under certain conditions of ambient air and water temperature. However, under extreme conditions the heat produced in the system or from environmental factors may be such that the purging of excess heat is required. Accordingly, the present invention provides for a forced draft condenser wherein water from the circulating loop is introduced over the condenser coils so that heat may be lost from the system both due to evaporation of the water as well as convective cooling. The unevaporated water is collected in the forced draft condenser and recirculated to the evaporator. Additional water may be added to the system as necessary to make up for evaporative losses.

The novelty of this invention therefore resides in both the use of the heat recovery principle in the recovery of ammonia refrigerant and in the simplification of the process of heat recovery to require only a single essentially closed loop of circulating water between the evaporator and condenser.

It is therefore an object of the present invention to provide for an ammonia recovery process with a heat recovery system to increase the thermodynamic efficiency of the condensation and evaporation processes.

A further object of the present invention is to provide for a heat recovery system that uses a simple, essentially-closed circulating water loop to transfer excess heat from the condensation process to the evaporation process.

Still another object of the present invention is to provide for a heat recovery system in which excess heat may be purged from the system by the evaporation of water in a forced draft condenser.

Yet another object of the present invention is to provide for a refrigerant recovery apparatus that is designed to fit onto a trailer so that it may be transported quickly and easily to and from remote job locations.

Further objects and advantages of the present invention will be apparent from a consideration of the following detailed description of the preferred embodiments in conjunction with the appended drawings as briefly described following.

DETAILED DESCRIPTION OF THE PREFERRED EMBODIMENTS

Figure 2:
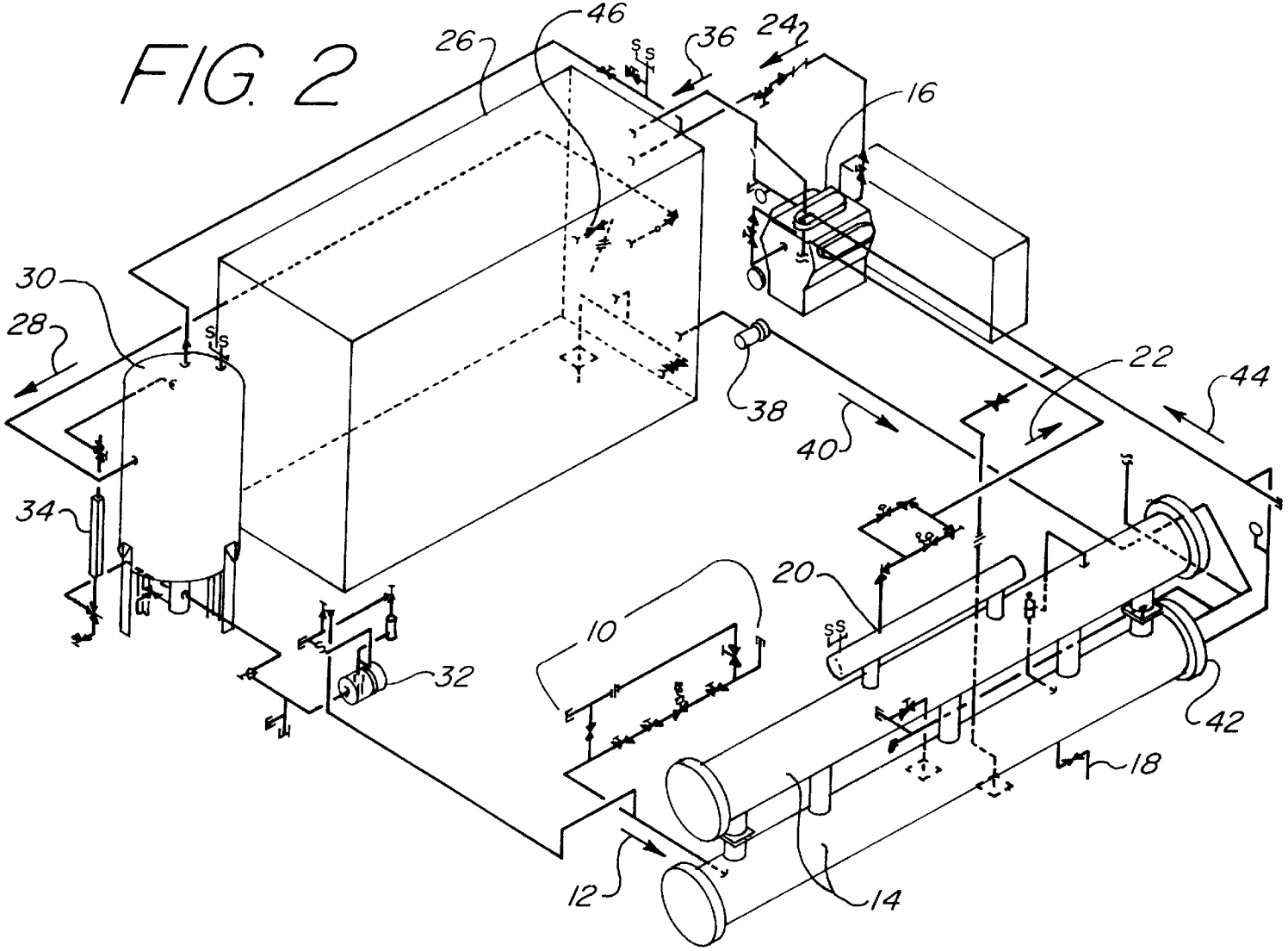
FIG. 2 is a perspective schematic view of the piping circuit formed by a preferred embodiment of the present invention.

Referring to FIG. 2, the steps through which ammonia refrigerant is cleaned and recovered in a preferred embodiment of the invention may be described. Although the preferred embodiment is directed toward the recovery of ammonia refrigerant, the invention is not so limited.

Ammonia from a refrigeration system (not shown) that is to be serviced enters the unit at ammonia connection points 10. The ammonia enters the unit in a liquid form. The liquid ammonia travels through the illustrated piping in the direction of arrow 12 and enters evaporator 14. Compressor 16 operates to lower the pressure within evaporator 14, causing the ammonia to change state from a liquid to a gas. Water, oil, and other contaminants that were mixed with the contaminated liquid ammonia when it entered the unit are thus separated from the ammonia. The contaminants may be removed from the system after use by opening waste drain 18.

The gaseous ammonia rises and exits the evaporator at ammonia evaporator exit point 20. The gas travels through the piping in the direction of arrow 22, through compressor 16, and then in the direction of arrow 24 into condenser 26. In condenser 26, the ammonia is cooled, and compressor 16 induces a greater pressure on the ammonia, which causes the gaseous ammonia to return to a liquid state. The liquid ammonia is then pumped from condenser 26 in the direction of arrow 28 into receiver 30. From receiver 30, the cleaned liquid ammonia may either be returned to the refrigeration system that is being serviced or may be stored for later use. Ammonia transfer pump 32 is used to draw the liquid ammonia from receiver 30 and out of the unit. Sight glass 34 allows the operator to monitor the level of liquid ammonia currently held in receiver 30.

The essentially-closed circulating water loop will next be described. While water is used as a heat transfer liquid in this preferred embodiment, the invention is not so limited, and any liquid that conducts heat sufficiently may be used. Beginning at compressor 16, relatively cool water is pumped from compressor 16 into condenser 26 in the direction of arrow 36. The process of converting ammonia from gaseous to liquid state within condenser 26 gives off heat. This heat is transferred to the water passing through condenser 26, and thus the water aids in the process of converting the ammonia from gaseous to liquid form.

The relatively hot water emerging from condenser 26 travels through water pump 38, which recirculates the water through the loop, and moves in the direction of arrow 40 into evaporator 14. In the preferred embodiment, the evaporator 14 is a shell-and-tube type heat exchanger. The water passes through the tube (not shown) inside evaporator 14 and in so doing transfers its heat to the liquid ammonia. This heat aids in the process of converting the liquid ammonia to a gaseous state. After giving up this heat, the water is again relatively cool and is pumped out of evaporator 14 at water evaporator exit point 42. The relatively cool water then returns to compressor 16 in the direction of arrow 44.

In a preferred embodiment of the invention, condenser 26 is of the forced-draft type. In this embodiment, the relatively cool water entering condenser 26 from compressor 16 flows over a multitude of coils (not shown) inside condenser 26 through which ammonia passes. The relatively cool water may thus cool the ammonia both by conductive heat transfer and by evaporation of the water into the atmosphere. Water lost through this evaporation process is replaced in the system by connecting outside water supply connection 46 with an external source of water. The amount of outside water that is necessary will depend upon the ambient temperature and humidity, as well as the temperature of the water that is being drawn from the outside source. Experiments have shown that more external water needs to be added when the unit is operated in the hot, humid climate typical of the extreme southern United States during the summer.

Figure 1:
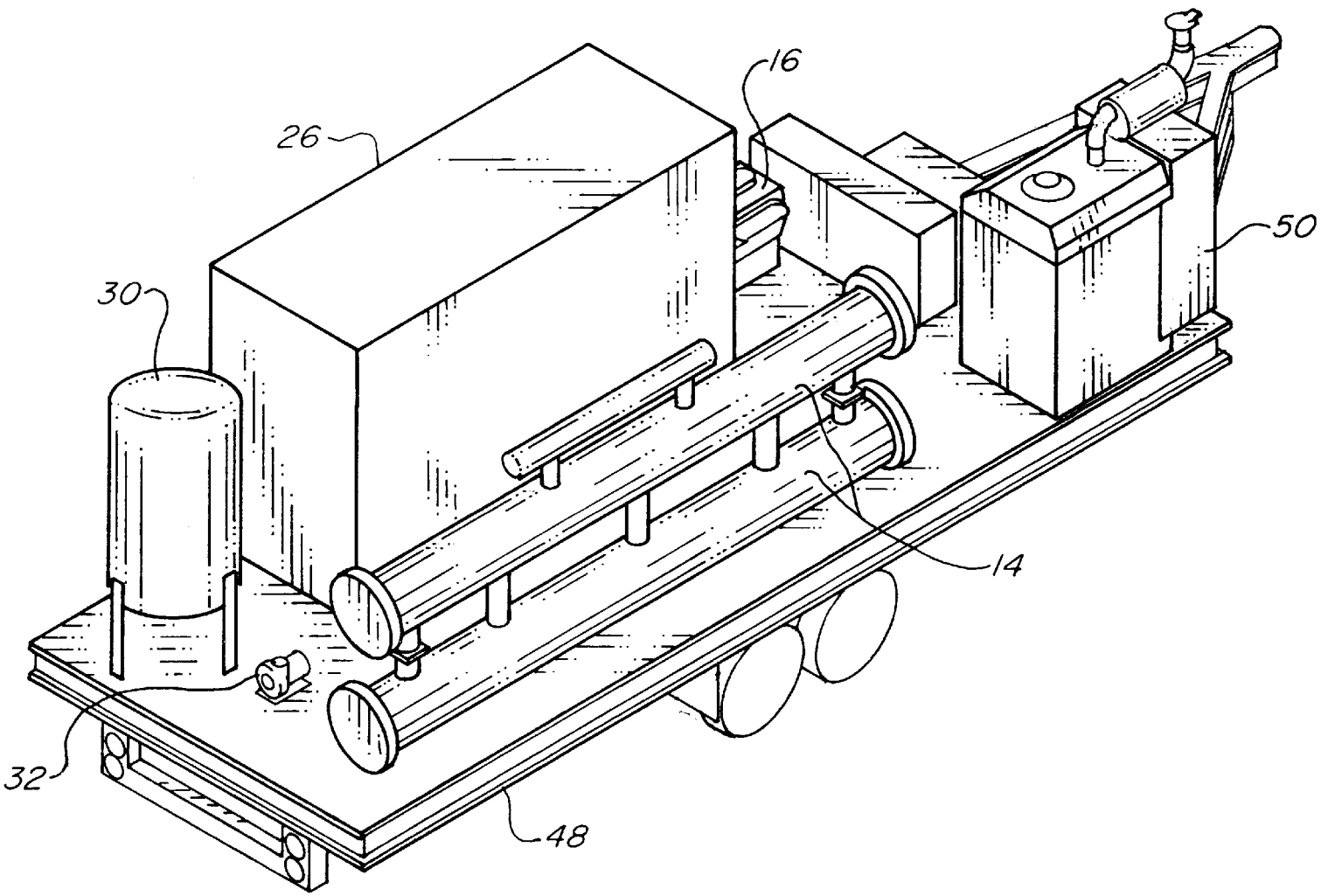
FIG. 1 is a perspective view of a preferred embodiment of the present invention with piping omitted.

Referring to FIG. 1, several major components of a preferred embodiment of the invention are shown, with piping omitted for clarity. The ammonia recovery unit is fitted onto a trailer 48 so that it may be easily transported to and from various job locations. Alternatively, the ammonia recovery unit may be mounted directly onto the bed of a flatbed truck, or upon any other transportation device large enough to carry the unit.

Since the ammonia recovery unit is self-contained, operation requires a minimal amount of preparation once the job location is reached. The operator need not remove the unit from the truck or trailer, and the unit may be permanently attached if desired for stability and safety. The operator need only make two connections once the unit arrives at the job location. First, the operator must connect the ammonia refrigeration equipment that is to be serviced to one or more of the ammonia connection points 10. Then, if external water is to be used, the operator must connect the unit's water input to the local water supply at outside water supply connection 46. The unit may then be used to clean and recover the ammonia from the refrigeration unit in need of service. Power for the unit is provided by diesel power unit 50. Diesel power unit 50 directly powers compressor 16, and also provides power to generate the electricity needed to operate ammonia transfer pump 32 and water pump 38.

The present invention has been described with reference to certain preferred and alternative embodiments which are considered exemplary only and not limiting to the full scope of the invention as set forth in the appended claims.

What is claimed is:

1. An apparatus for cleaning and recovering refrigerant, comprising:

(a) a liquid refrigerant introduced to the apparatus;

(b) an evaporator, said evaporator comprising an evaporator liquid refrigerant input and an evaporator gaseous refrigerant output;

(c) a compressor which induces a lowered ambient pressure inside said evaporator to convert a refrigerant therein from liquid state to gaseous state;

(d) a condenser, said condenser comprising a condenser gaseous refrigerant input and a condenser liquid refrigerant output;

(e) a gaseous refrigerant pathway, said pathway allowing said refrigerant to flow from said evaporator gaseous refrigerant output to said condenser gaseous refrigerant input; and (f) a heat transfer loop, said heat transfer loop containing a heat transfer liquid and passing through said evaporator and said condenser proximally to said refrigerant, such that said heat transfer liquid is heated as it passes through said condenser and cooled as it passes through said evaporator, wherein said evaporator further comprises a contaminate drain for the removal of contaminants separated from said refrigerant when said refrigerant is converted from a liquid state to a gaseous state.

2. An apparatus according to claim 1, wherein said refrigerant is ammonia.

3. An apparatus according to claim 1, further comprising:

(a) a refrigerant receiver tank, said refrigerant receiver tank providing for the storage and subsequent transfer of said refrigerant; and (b) a liquid refrigerant pathway, said liquid refrigerant pathway allowing the passage of said refrigerant from said condenser liquid refrigerant output to said refrigerant receiver tank.

4. An apparatus according to claim 1, wherein said condenser is a forced-draft condenser, said forced-draft condenser comprising:

(a) one or more coils through which said refrigerant may pass, each one of said one or more coils having two ends, one end communicatively connected to said condenser gaseous refrigerant input, and the other end communicatively connected to said condenser liquid refrigerant output; and (b) one or more pathways through which said heat transfer liquid may pass, said one or more pathways located such that said heat transfer liquid flowing through said one or more pathways makes substantial contact with said one or more coils.

5. An apparatus according to claim 1, wherein said heat transfer liquid is water.

6. An apparatus according to claim 5, wherein said condenser further comprises an external water source input, said external water source input allowing the introduction of additional water from an external source into said heat transfer loop.

7. A method for cleaning and recovering refrigerant, comprising the steps of:

(a) moving a refrigerant in a liquid state from an external refrigeration system into an evaporator;

(b) using a compressor to induce a lowered ambient pressure inside said evaporator to convert said refrigerant therein from a liquid state to a gaseous state;

(c) moving said refrigerant in a gaseous state into a condenser and converting said refrigerant therein from a gaseous state to a liquid state; and (d) moving a heat transfer liquid in a recirculating path through said condenser and said evaporator proximally to said refrigerant such that said heat transfer liquid is heated as it passes through said condenser and said heat transfer liquid is cooled as it passes through said evaporator, further comprising the step of draining contaminates remaining in said evaporator from said evaporator once cleaning and recovery of said refrigerant is complete.

8. A method according to claim 7, wherein said refrigerant is ammonia.

9. A method according to claim 7, further comprising the step of moving said refrigerant in a liquid state from said condenser to a refrigerant receiver tank for storage.

10. A method according to claim 9, further comprising the step of moving said refrigerant in a liquid state from said refrigerant receiver tank to said external refrigeration system.

11. A method according to claim 7, wherein said condenser is a forced-draft condenser, wherein step (d) further comprises the steps of:

(a) directing said heat transfer liquid along one or more pathways that flow over one or more coils in said condenser through which said refrigerant flows; and (b) allowing some portion of said heat transfer liquid to evaporate into the atmosphere to aid in the cooling of said refrigerant flowing through said one or more coils in said condenser.

12. A method according to claim 7, wherein said heat transfer liquid is water.

13. A method according to claim 7, further comprising the step of introducing an external source of water into said heat transfer loop.

14. A method according to claim 7, further comprising the step prior to step (a) of transporting all components necessary to perform the method to a location proximal to said external refrigeration system via a transportation device upon which said components are mounted.

15. An apparatus according to claim 1, further comprising a transportation device upon which all other elements of said apparatus are mounted.

16. An apparatus for cleaning and recovering ammonia refrigerant, comprising:

(a) a liquid ammonia refrigerant introduced to the apparatus;

(b) an evaporator, said evaporator comprising an evaporator liquid ammonia refrigerant input and an evaporator gaseous ammonia refrigerant output;

(c) a heat source applied to said evaporator and a compressor which induces a lowered ambient pressure inside said evaporator to convert said liquid ammonia refrigerant therein from liquid state to gaseous state;

(d) a condenser, said condenser comprising a condenser gaseous ammonia refrigerant input and a condenser liquid ammonia refrigerant output; and (e) a gaseous ammonia refrigerant pathway, said pathway allowing said ammonia refrigerant to flow from said evaporator gaseous ammonia refrigerant output to said condenser gaseous ammonia refrigerant input;

(f) said heat source comprising a heat transfer loop, said heat transfer loop containing a heat transfer liquid and passing through said evaporator and said condenser proximally to said ammonia refrigerant, such that said heat transfer liquid is heated as it passes through said condenser and cooled as it passes through said evaporator.

17. An apparatus according to claim 15, further comprising a transportation device upon which all other elements of said apparatus are mounted.

18. An apparatus according to claim 15, wherein said evaporator further comprises a contaminate drain for the removal of contaminants separated from said ammonia refrigerant when said ammonia refrigerant is converted from a liquid state to a gaseous state.

19. An apparatus according to claim 15, further comprising:

(a) an ammonia refrigerant receiver tank, said ammonia refrigerant receiver tank providing for the storage and subsequent transfer of said ammonia refrigerant; and (b) a liquid ammonia refrigerant pathway, said liquid ammonia refrigerant pathway allowing the passage of said ammonia refrigerant from said condenser liquid ammonia refrigerant output to said ammonia refrigerant receiver tank.

20. An apparatus according to claim 15, wherein said condenser is a forced-draft condenser, said forced-draft condenser comprising:

(a) one or more coils through which said ammonia refrigerant may pass, each one of said one or more coils having two ends, one end communicatively connected to said condenser gaseous ammonia refrigerant input, and the other end communicatively connected to said condenser liquid ammonia refrigerant output; and (b) one or more pathways through which said heat transfer liquid may pass, said one or more pathways located such that said heat transfer liquid flowing through said one or more pathways makes substantial contact with said one or more coils, wherein said heat transfer liquid is water whereby some portion of said heat transfer liquid evaporates into the atmosphere to aid in the cooling of said ammonia refrigerant flowing through said one or more coils in said condenser;

and further wherein said condenser further comprises an external water source input, said external water source input allowing the introduction of additional water from an external source into said heat transfer loop.

* * * * *